United States Patent [19]

Cordeiro

[11] Patent Number: 4,718,865

[45] Date of Patent: Jan. 12, 1988

[54] INSULATED ELECTRICAL PLUG

[75] Inventor: August V. Cordeiro, East Greenwich, R.I.

[73] Assignee: Electric Terminal Corporation, Warwick, R.I.

[21] Appl. No.: 896,669

[22] Filed: Aug. 14, 1986

Related U.S. Application Data

[63] Continuation of Ser. No. 693,041, Jan. 22, 1985, abandoned.

[51] Int. Cl.[4] ..... H01R 19/04

[52] U.S. Cl. ..... 439/606; 439/695

[58] Field of Search ..... 264/272.11; 339/196 R, 339/196 M, 218 R, 218 M, 63 R, 63 M; 439/600, 601, 604–606, 692–697

[56] References Cited

U.S. PATENT DOCUMENTS 4,130,333 12/1978 Djurinee ..... 339/97 P

*Primary Examiner*—Gil Weidenfeld

*Assistant Examiner*—Gary F. Paumen

[57] ABSTRACT

An electrical plug including an electrically conductive contact member, a wire attached to the contact member, a cover made of electrically insulating material and covering the exposed portion of the wire and the attached portion of the contact member, and a molded plastic housing embedding the cover, the contact member and wire.

3 Claims, 4 Drawing Figures

INSULATED ELECTRICAL PLUG

This application is a continuation of application Ser. No. 693,041 filed Jan. 22, 1985 now abandoned.

FIELD OF THE INVENTION

The invention relates to electrical plugs.

BACKGROUND OF THE INVENTION

One way of manufacturing electrical plugs involves connecting a pair of electrically conductive contact members to electrical wires by crimping and embedding the contact members and attached wires in a molded plastic housing. Occassionally an exposed portion of an electrical wire works its way to the surface of the molded plastic during the molding step, resulting in a defective plug. One way to avoid this problem has been to use two molding steps.

SUMMARY OF THE INVENTION

I have discovered that I can avoid the problems of an exposed wire working its way to the surface in a molded plastic housing of a plug by covering the exposed portion of the electrical wire and the attached portion of the contact member with a cover of insulating material prior to embedding the wire and contact member in the molded plastic housing.

In preferred embodiments, the cover has a cavity for receiving the wire and attached portion of the contact member, a first opening at one end of the cavity for the wire, a second opening at the other end of the cavity for the contact member and a recess extending from the cavity; and the blade is formed of a folded-back strip of metal and has a bent locking tab that is received in the recess.

DESCRIPTION OF THE PREFERRED EMBODIMENT

I will now describe the structure and manufacture of the presently preferred embodiment of the invention, after first briefly describing the drawings.

Drawings

STRUCTURE

Figure 1:
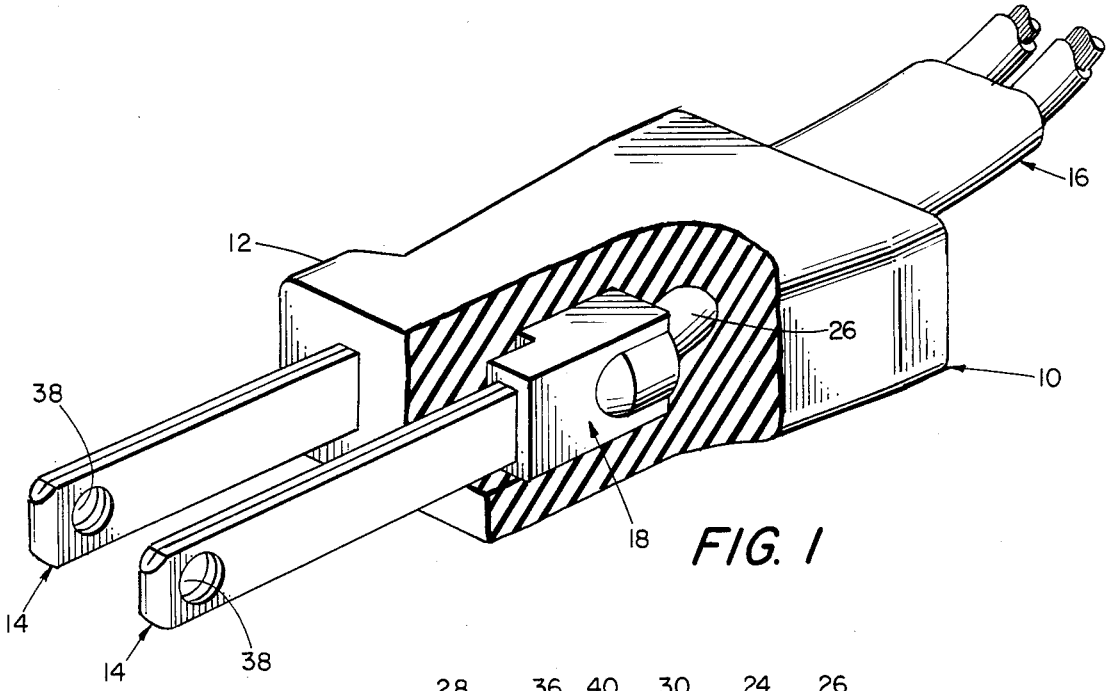
FIG. 1 is a perspective view, partially broken away, of a plug according to the invention.

Referring to FIG. 1, there is shown plug 10 made of molded plastic housing 12, electrically conducting brass blades 14, electrical wire 16, and insulating cover 18 (of nylon available from DuPont under the Zytel 101 trade designation).

Figure 2:
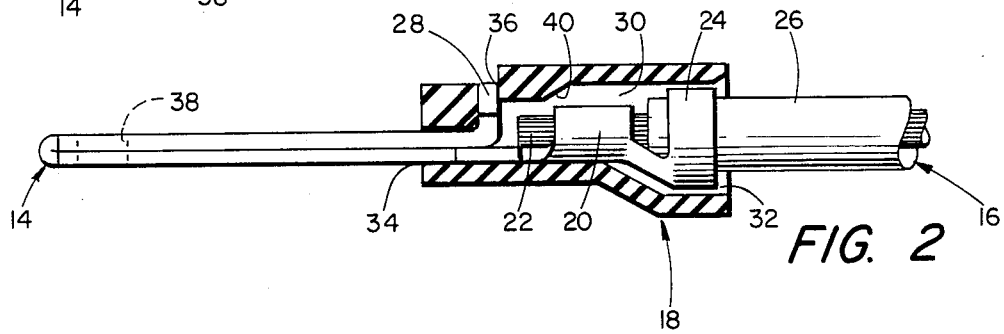
FIG. 2 is an elevation, partially in section, showing the blade, wire and cover components of the FIG. 1 blade during manufacture.

Referring to FIG. 2, it is seen that blade 14 is made of a folded-over strip of metal. At one end of the strip of metal are crimped fingers 20, engaging exposed portion 22 of one conductor of electrical wire 16, and crimped fingers 24, engaging insulator 26 of wire 16. At the other end of the strip of metal of blade 14 is transverse locking tab 28. Cover 18 has cavity 30 for receiving the wire and crimped fingers 20, 24 of blade 14. Wire 16 passes through rear opening 32 of cover 18, and blade 14 passes through front opening 34. Opening 36 provides a recess that receives locking tab 28 of blade 14. Inclined surface 40 flexes tab 28 during insertion.

Blades 14 have holes 38 therethrough near their ends.

Manufacture

Figure 3:
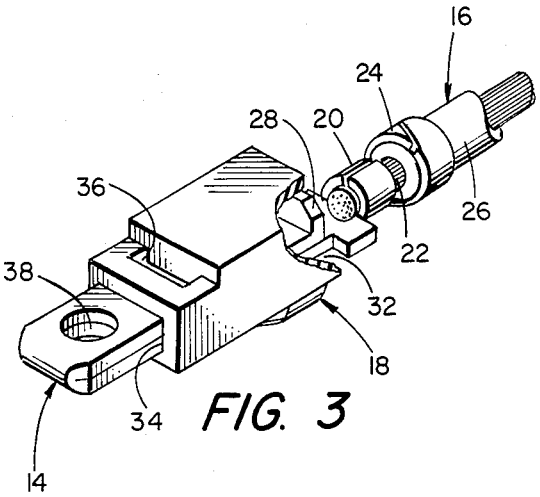
FIG. 3 is a perspective view showing the FIG. 2 components in a different position during manufacture.
Figure 4:
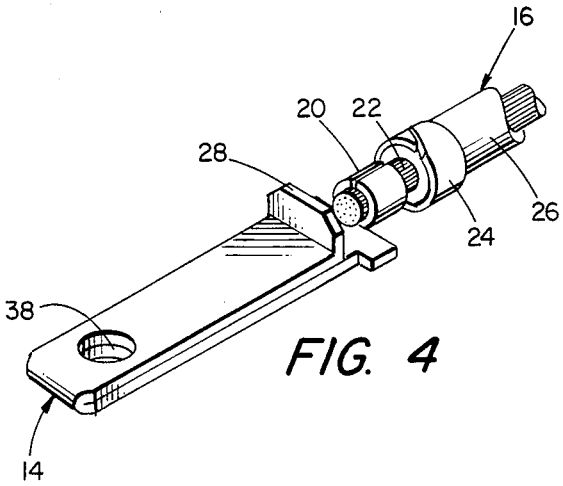
FIG. 4 is a perspective view showing the blade and wire components of the FIG. 1 plug.

Referring to FIG. 4, during manufacture, one conductor of wire 16 is attached to blade 14 by crimping fingers 20, 24. Blade 14 is then inserted into rear opening 32 to cavity 30, as shown in FIG. 3. As blade 14 is pushed further, transverse tab 28 is biased downward by inclined surface 40 and then expands again into opening 36, locking tab 28 in place (FIG. 2). The other conductor of wire 16 is similarly connected to another blade 14 and cover 18. The pair of such blades and covers and the connected wire are then placed in a mold and provided with molded plastic housing 12.

Exposed portions 22 of the conductors of electrical wire 16 are covered by cover 18 and prevented from working their way into molded plastic housing 12 or to its surface.

Other Embodiments

Other embodiments of the invention are within the scope of the following claims.

What is claimed is:

1. An electrical plug comprising a wire, a blade, a preformed cover, and a housing, said wire comprising a multiplicity of strands covered by insulation, end portions of said strands being exposed, said blade including a first gripping portion engaging said exposed end portions of said strands, a contact portion, a bent tab extending transversely from said blade between said first gripping portion and said contact portion, and a second gripping portion engaging said insulation, said cover completely surrounding said exposed end portions, first and second gripping portions and insulation so as to prevent loose exposed strands from extending from said cover, and including a cavity for receiving said gripping portions and attached wire, a first opening at one end of said cavity through which said wire passes, and a second opening at the other end of said cavity from which said contact portion of said blade extends, a recess extending from said cavity, and an inclined surface leading to said recess for flexing said tab prior to being received in said recess.

said housing being of insulating material and being molded over said cover completely therearound.

2. The plug of claim 1 in which said end of said wire and said contact portion of said blade are axially aligned.

3. The plug of claim 2 in which said cover additionally extends completely around said end of said wire for a distance outwardly thereof longitudinally of said blade.

* * * * *